United States Patent [19]

Lense

[11] Patent Number: 4,703,960

[45] Date of Patent: Nov. 3, 1987

[54] POWER-OPERATED WINDOW LOCK

[75] Inventor: Robert F. Lense, Rockford, Ill.

[73] Assignee: Amerock Corporation, Rockford, Ill.

[21] Appl. No.: 848,256

[22] Filed: Apr. 4, 1986

[51] Int. Cl.[4] ..... E05C 5/00; E95E 15/14

[52] U.S. Cl. ..... 292/69; 292/192; 292/201; 292/216; 292/DIG. 33; 49/280

[58] Field of Search ..... 292/201, 191, 192, DIG. 33, 292/216, 69; 49/139, 280

[56] References Cited

U.S. PATENT DOCUMENTS

| | | | |
|---|---|---|---|
| 2,896,990 | 7/1959 | Garvey et al. | 292/201 |
| 2,898,138 | 8/1959 | Van Noord | 292/201 |
| 3,016,968 | 1/1962 | Lenz et al. | 292/201 |
| 3,328,060 | 6/1967 | Soderberg | 292/216 |
| 4,111,473 | 9/1978 | Bourrie et al. | 292/201 |
| 4,126,341 | 11/1978 | Bradstock | 292/201 |

FOREIGN PATENT DOCUMENTS

| | | | |
|---|---|---|---|
| 1295710 | 11/1972 | United Kingdom | 292/201 |

OTHER PUBLICATIONS

Three Photographs and a Hand-Written Description of a General Motors Corporation Power Door Lock Actuator.

*Primary Examiner*—William F. Pate, III
*Assistant Examiner*—Michael Safavi
*Attorney, Agent, or Firm*—Leydig, Voit & Mayer, Ltd.

[57] ABSTRACT

The latching bolt of a window lock is pivotally mounted on a slide to pivot between locked and unlocked positions. A reversible motor with a rotary drive shaft is adapted to reciprocate the slide outwardly and inwardly by means of a scotch yoke connection between the drive shaft and the slide, the scotch yoke being of the lost-motion type so as to permit the slide to shift independently of the drive. When the slide is shifted outwardly, the bolt is permitted to pivot to its unlocked position and, when the slide is shifted inwardly, the bolt is cammed to its locked position. A lever may be operated manually to unlock the bolt in the event there is a loss of power to the motor.

11 Claims, 14 Drawing Figures

POWER-OPERATED WINDOW LOCK

BACKGROUND OF THE INVENTION

This invention relates to a power-operated locking device and, more particularly, to a power-operated locking device for locking a swingable window sash such as a casement window sash in a closed position.

Prior power-operated locks for windows are comparatively large and bulky and project a substantial distance into the room. As a result, such locks present a rather unattractive appearance and tend to interfere with blinds, drapes and the like which are mounted on the inside of the window frame.

In addition, prior power-operated locks for windows are capable of only limited travel and are not capable of reaching out to a less than fully closed window sash and drawing the sash inwardly to a tightly closed position. This particularly creates a problem in installations where the window is equipped with two spaced locks and where the window sash may be partially warped.

SUMMARY OF THE INVENTION

The general aim of the present invention is to provide a new and improved power-operated window lock which, when compared with prior locks, is of relatively compact and miniaturized construction and is capable of drawing a swingable window sash inwardly through a substantial distance to a closed position.

Another object of the invention is to provide a power-operated window lock in which a latching bolt is uniquely mounted to move between latched and unlatched positions on a linearly movable carrier which is adapted to be driven inwardly and outwardly to effect locking and unlocking of the window sash.

A more detailed object of the invention is to provide a novel lost-motion connection between the carrier and the carrier driver in order to permit the carrier to move through a limited range independently of the driver and enable the latching bolt to operably engage the strike of the sash as the sash approaches its closed position. Thereafter, the carrier is positively driven to cause the bolt to draw the window inwardly to a tightly closed position.

Another object is to provide a power-operated lock which may be easily operated in a manual mode in the event of a power failure or a malfunction in the lock.

These and other objects and advantages of the invention will become more apparent from the following detailed description when taken in conjunction with the accompanying drawings.

DETAILED DESCRIPTION OF THE PREFERRED EMBODIMENT

Figure 1:
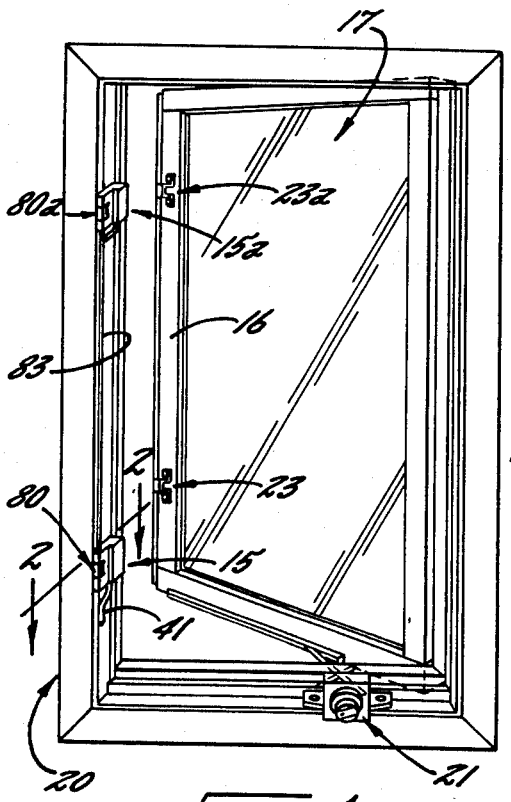
FIG. 1 is a front elevational view of a typical window equipped with new and improved power-operated locking devices incorporating the unique features of the present invention.

For purposes of illustration, the invention has been shown in the drawings in connection with a power-operated locking device 15 for holding the sash 16 of a window 17 in a closed position against the jamb 19 of the window frame 20. In the present instance, the window is a casement window and thus the sash is adapted to swing outwardly from a closed position to an open position about a laterally floating upright axis located adjacent one vertical side of the sash. While the window may be opened and closed by a conventional crank mechanism, the window herein is equipped with a power-operated opening and closing mechanism 21. Reference may be made to Lense U.S. Pat. No. 4,553,656 for a detailed disclosure of the construction and operation of the opening and closing mechanism 21.

The locking device 15 is located on the side of the window jamb 19 adjacent the free upright side of the sash 16 and coacts with a strike 23 mounted on the lower portion of the free upright side of the sash. An upper strike **23*a* (FIG. 1) is attached to the upper portion of the free upright side of the sash and is adapted to coact with an upper locking device 15*a*. Only the lower locking device 15 and strike 23** will be described in detail since the upper components are virtually identical to the lower components.

Figure 13:
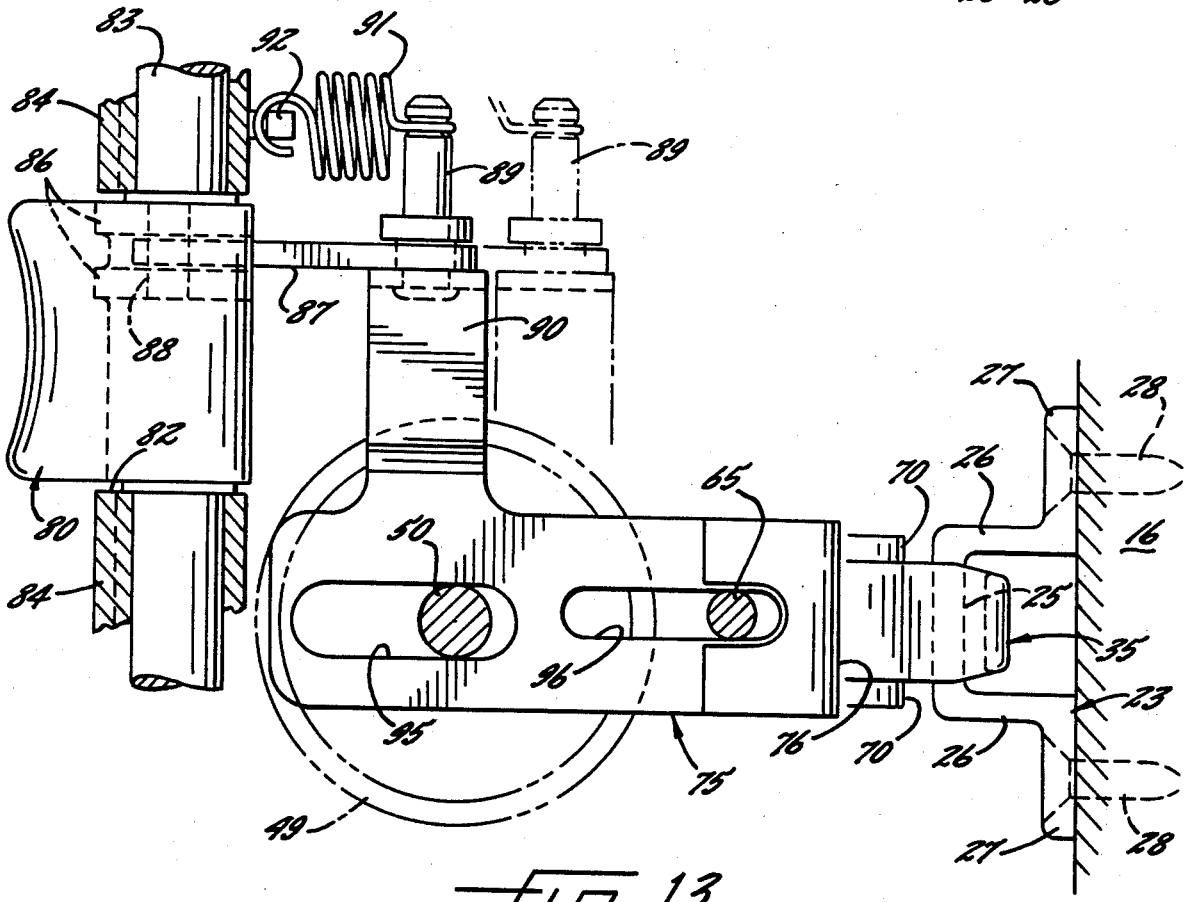
FIG. 13 is a fragmentary cross-section taken substantially along the line 13—13 of FIG. 12.

As shown most clearly in FIG. 13, the strike 23 is generally U-shaped and includes an inner vertically extending cross piece or bail 25 spaced inwardly from the sash 16 and formed integrally with the inner ends of upper and lower legs 26 which project inwardly from the sash. Mounting flanges 27 are formed integrally with the outer ends of the legs and are attached to the inner side of the sash by screws 28 which serve to secure the strike to the sash.

The present invention contemplates the provision of an extremely small and compact power-operated locking device 15 which is capable of repeatedly and reliably drawing the sash 16 inwardly a substantial distance into a tightly closed position. The compact construction of the lock 15 enables the latter to be mounted on the frame 20 without interfering with blinds or other window coverings while the good repeatability and substantial draw-in of the lock insures tight closing of the sash even though the sash or the frame may be vertically warped.

Figure 2:
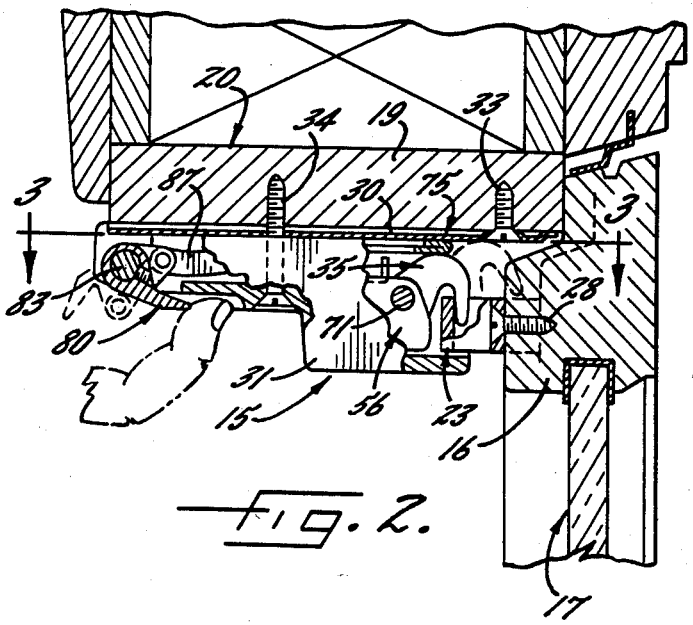
FIG. 2. is an enlarged fragmentary cross-section taken substantially along the line 2—2 of FIG. 1.

More specifically, the lock 15 includes a sheet metal cover plate 30 (FIG. 14) which is secured to a hollowed-out base or housing 31 by screws 32, the housing being a die cast member. The unit formed by the cover and the housing is located within a mortise in the frame 20 and is secured to the frame by a pair of screws 33 and 34 (FIG. 2). The screw 33 extends through the cover 30 while the screw 34 extends through both the housing and the cover.

Figure 6:
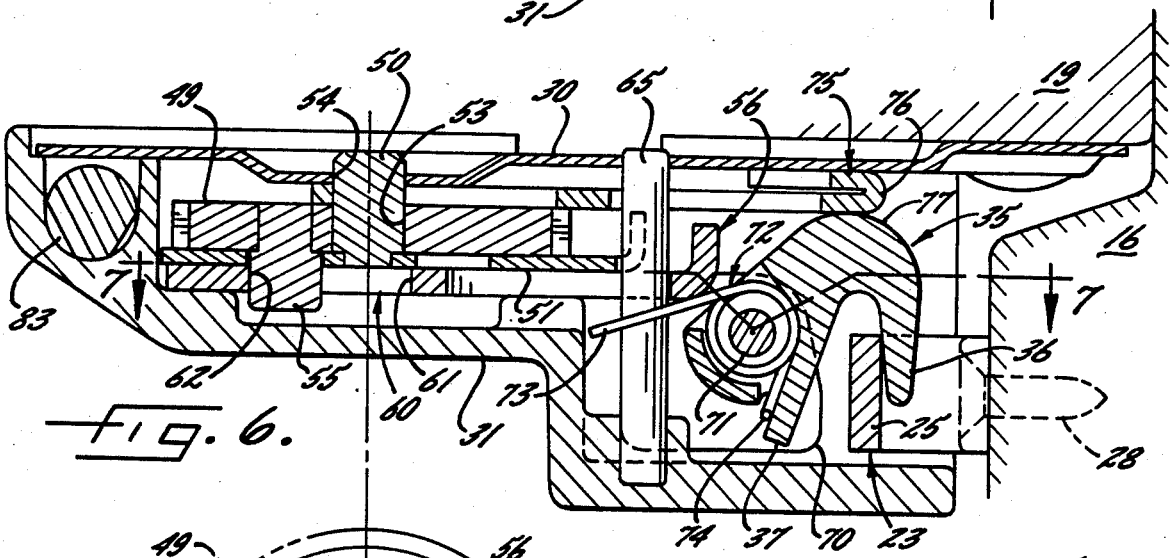
FIG. 6 is an enlarged fragmentary cross-section taken substantially along the line 6—6 of FIG. 3 and shows the latching bolt in its fully locked position.

A latching bolt 35 is located within the housing 31 and is adapted to engage and release the strike 23 to lock and unlock the sash 16. Herein, the latching bolt 35 is a generally U-shaped member which is formed with spaced outer and inner legs 36 and 37. When the sash 16 is closed and the bolt is in its fully locked position as shown in FIG. 6, the outer leg 36 of the bolt hooks around the bail 25 of the strike 23 and engages the outer side of the bail to hold the sash 16 in a tightly closed position. When the bolt is moved to its fully unlocked position (see FIG. 8), the outer leg 36 of the bolt pulls out of the strike 23 and releases the bail 25 to permit the sash to swing to its open position.

Figure 5:
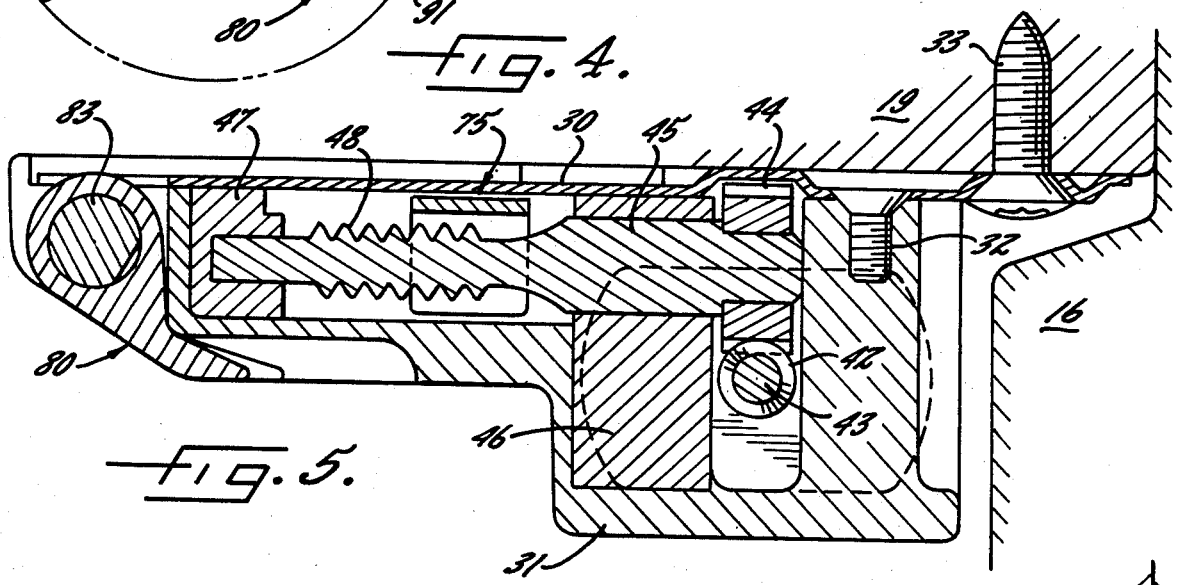

Power operation of the latching bolt 35 is effected by a reversible actuator which herein takes the form of a reversible electric motor 39 (FIGS. 3 and 14) suitably supported within a cavity 40 (FIG. 14) in the housing 31 and having lead wires 41 adapted for connection to a voltage source. A worm 42 (FIGS. 5 and 14) is carried on the rotary output shaft 43 of the motor and meshes with a worm wheel 44 on a shaft 45. The latter is rotatably supported by bearings 46 and 47 in the housing 31 and is formed with a worm 48 which meshes with a drive gear in the form of a comparatively large worm wheel 49. To support the drive gear 49 for rotation, a stud 50 (FIGS. 3 and 14) is fixed to a mounting plate 51 which is anchored in a fixed position in a cavity 52 (FIG. 14) in the housing. The stud extends through a hole 53 in the drive gear 49 and also through a hole 54 in the cover 30, the drive gear rotating on the stud. By virtue of the reduction effected by the gears 42, 44, 48 and 49, the drive gear 49 rotates through about one revolution for every one thousand revolutions of the motor output shaft 43.

Pursuant to the invention, the drive gear 49 carries an eccentric 55 (FIGS. 6, 7 and 14) which effects outward and inward linear shifting of a carrier or slide 56 which, in turn, supports the latching bolt 35 for movement between its locked and unlocked positions. Herein, the eccentric is a crank pin which is fixed rigidly to the drive gear 49 in radially offset relation from the rotational axis of the gear as defined by the stud 50. The crank pin 55 extends through an arcuate slot 57 (FIG. 14) in the fixed mounting plate 51 and projects into an enlarged opening 60 formed in the inner end portion of the slide 56. When the drive gear 49 is rotated back and forth, the eccentric crank pin 55 bears against the outer and inner edges 61 and 62 of the opening 60 and shifts the slide 56 and the latching bolt 35 outwardly and inwardly. Thus, the crank pin 55 and the opening 60 coact to define a form of a scotch yoke for converting the rotary motion of the drive gear into linear motion of the slide. For an important purpose to be described subsequently, however, the outer and inner edges 61 and 62 of the opening 60 are not spaced from one another by a distance substantially equal to the diameter of the crank pin 55 as would be the case with a conventional scotch yoke but instead are spaced apart by a distance substantially greater than the diameter of the crank pin. In the present instance, the spacing between the outer and inner edges 61 and 62 of the opening 60 is about $2\frac{1}{2}$ times the diameter of the crank pin. As a result, a lost motion connection is created between the crank pin 55 and the slide 56 to enable the pin to positively drive the slide while enabling the slide to shift through a limited range independently of the pin.

Figure 14:
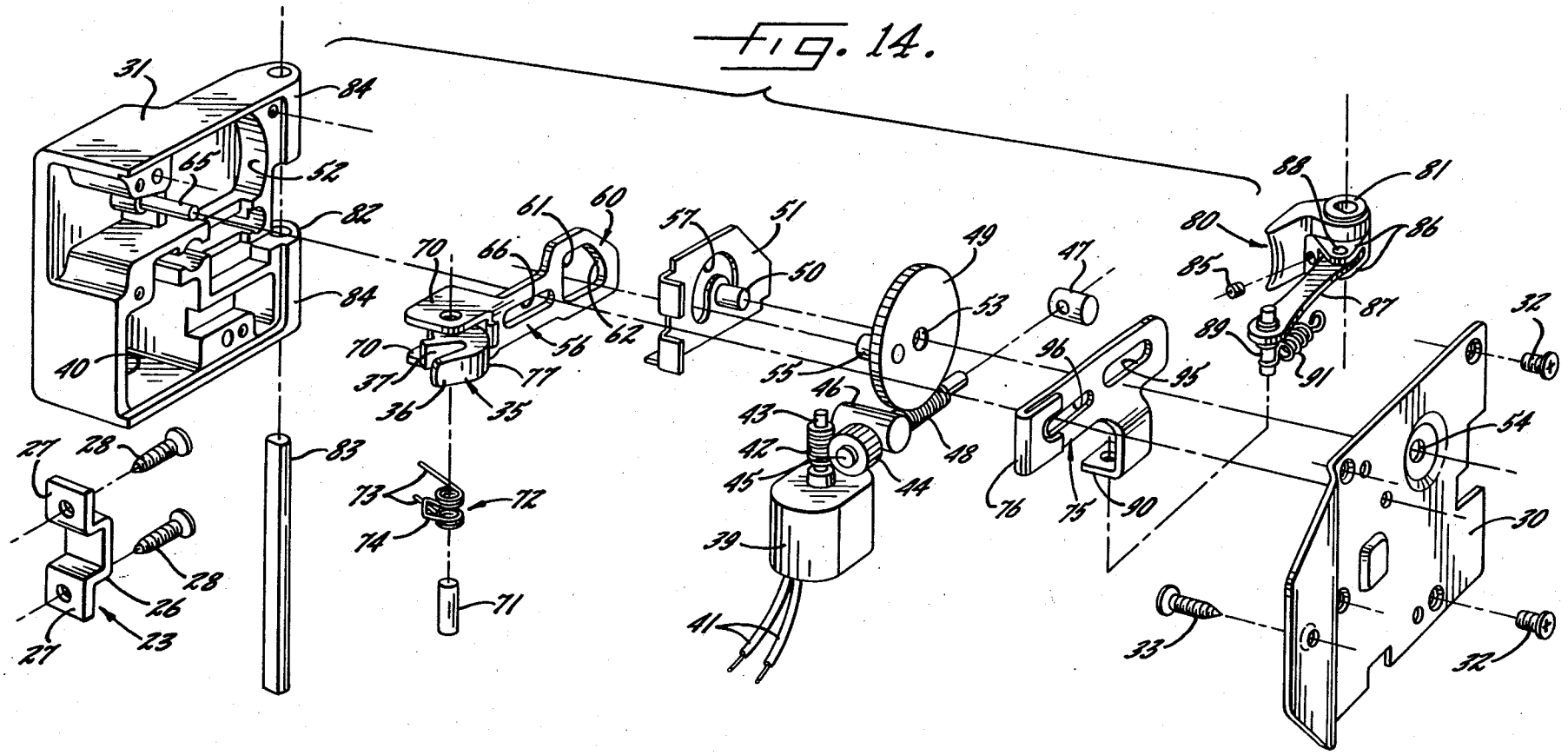
FIG. 14 is an exploded perspective view of the locking device.

The slide 56 is disposed in the cavity 52 of the housing 31 and is guided for outward and inward linear movement by the walls of the cavity and by a guide pin 65. As shown in FIG. 14, the guide pin is fixed to the housing and projects through an elongated slot 66 in the slide 56. The free end of the guide pin is anchored to the cover 30 (see FIG. 12).

Formed integrally with the outer end portion of the slide 56 are two vertically spaced ears 70 (FIG. 14) which straddle the latching bolt 35. A pin 71 extends through the ears and the latching bolt and supports the latching bolt to pivot on the slide between locked and unlocked positions. Encircling the pin 71 is a torsion spring 72 having end tangs 73 which bear against the slide and having a center yoke 74 which bears against the bolt. The spring urges the bolt to pivot counterclockwise about the pin 71 to its unlocked position (see FIG. 8).

To hold the latching bolt 35 in its locked position, an elongated cam plate 75 (FIGS. 6 and 14) is normally located in a fixed position within the housing 31 adjacent the cover 32. Formed on the outer end of the cam plate 75 is a rounded nose 76 which defines a cam surface. When the latching bolt 35 is in its fully locked position as shown in FIG. 6, the cam plate engages a rounded surface 77 on the bolt and prevents the bolt from pivoting counterclockwise toward its unlocked position.

Figure 7:
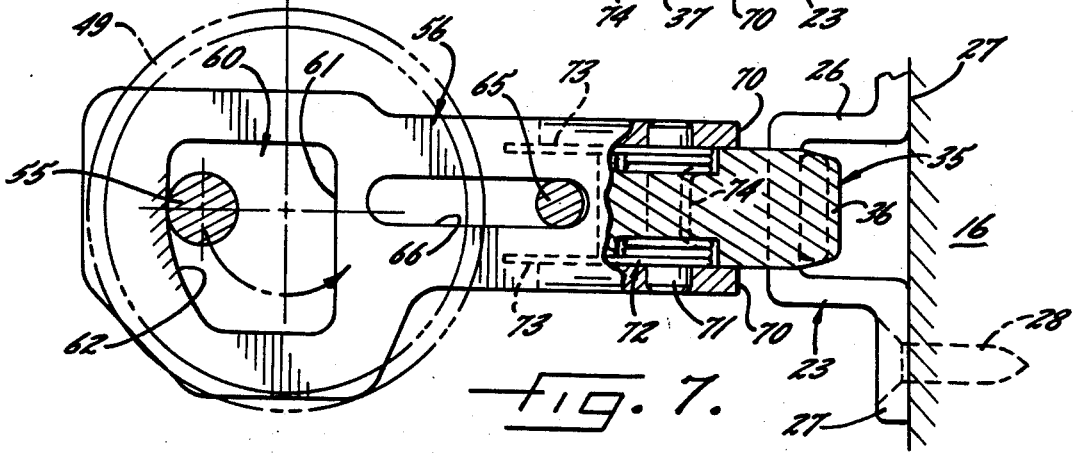
FIG. 7 is a fragmentary cross-section taken substantially along the line 7—7 of FIG. 6.

In order to explain the operation of the locking device 15 as described thus far, let it be assumed that the latch bolt 35 is in its fully locked position as shown in FIG. 6 with the outer leg 36 of the bolt fully hooked around and fully engaging the bail 25 of the strike 23 and holding the sash 16 tightly against the jamb 19. When the bolt is fully locked, the crank pin 55 is located in about a nine o'clock position as shown in FIG. 7 and bears against the inner edge 62 of the opening 60 in the slide 56. As a result, the pin holds the slide inwardly in a first position. As long as the slide is in its full inner position, the cam plate 75 bears against the rounded surface 77 on the bolt 35 and prevents the bolt from pivoting counterclockwise to its unlocked position under the bias of the torsion spring 72.

To initiate an unlocking cycle, the motor 39 is energized in a direction to cause the crank pin 55 to rotate counterclockwise through about one-half revolution from the position shown in FIG. 7. During initial counterclockwise rotation of the pin, the seals (not shown) between the sash 16 and the jamb 19 may decompress and pull the sash outwardly as much as 1/16". The sash acts through the strike 23 and the bolt 35 to pull the slide 56 outwardly through a corresponding distance and thereby keep the inner edge 62 of the opening 60 in contact with the crank pin 55 during initial counterclockwise rotation of the pin.

Because of the substantial spacing between the outer and inner edges 61 and 62 of the opening 60, the counterclockwise rotating crank pin 55 simply moves with lost motion within the opening and does not engage the outer edge of the opening to positively displace the slide 56 during approximately the first 105 degrees of rotation of the pin. When the pin has been rotated counterclockwise through about 105 degrees, the pin moves into engagement with the outer edge 61 of the opening 60 and begins positively displacing the slide 56 outwardly for the next approximately 75 degrees of rotation of the pin. During such outward displacement, the outer ends of the ears 70 of the slide engage the inner side of the bail 25 of the strike 23 and positively push the strike and the sash 16 outwardly in order to completely separte the sash from the jamb. Assuming that the decompressed seals previously opened the sash through 1/16", engagement of the ends of the ears 70 with the strike 23 during positive displacemet of the slide 56 causes the sash to open about an additional ⅛". If the sash for some reason had been stuck and had not been cracked open by decompression of the seals, counterclockwise rotation of the crank pin 55 through 180 degrees would act to positively displace the slide through a full 3/16" and cause the sash to be pushed open. In either case, therefore, outward movement of the slide 56 effects positive outward movement of the sash 16 from the jamb 19 to break any bond between the two and facilitate further opening of the sash either by hand or by the power operator 21.

Figure 8:
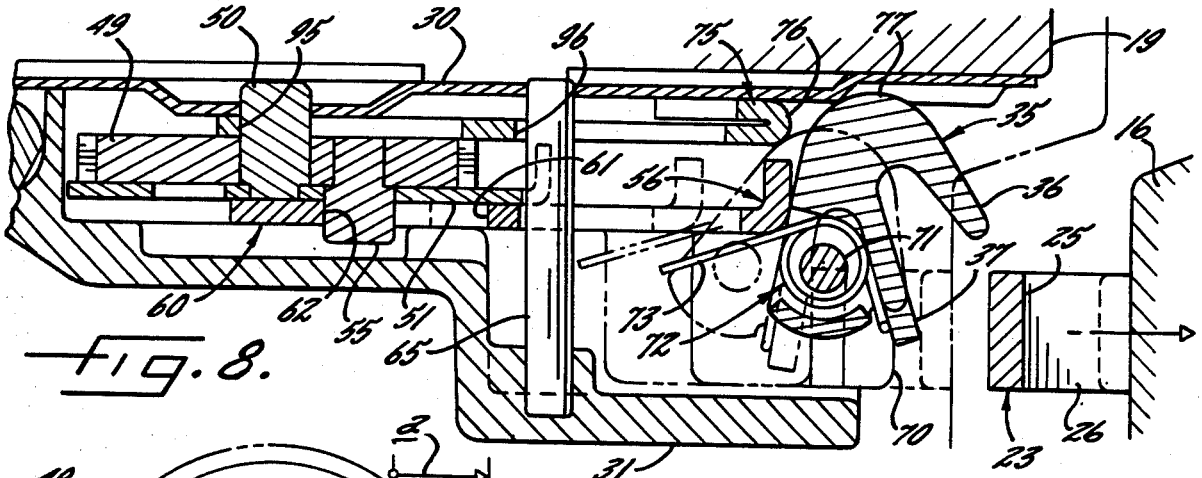
FIGS. 8 and 9 are views similar to FIGS. 6 and 7, respectively, but show the latching bolt in its fully unlocked position.

During positive outward displacement of the slide 56 by the crank pin 55, the bolt 35 moves outwardly to a predetermined position in which the rounded surface 77 of the bolt starts to leave the flat surface of the cam plate 75 and starts to approach the rounded nose 76 of the plate (see the phantom line position of FIG. 8). During such approach, the nose 76 permits the torsion spring 72 to pivot the bolt 35 counterclockwise from its fully locked position shown in FIG. 6 toward a partially unlocked position as shown in phantom lines in FIG. 8. In the partially unlocked position of the bolt 35, the outer leg 36 of the bolt is spaced outwardly from the bail 25 of the strike 23.

Figure 9:
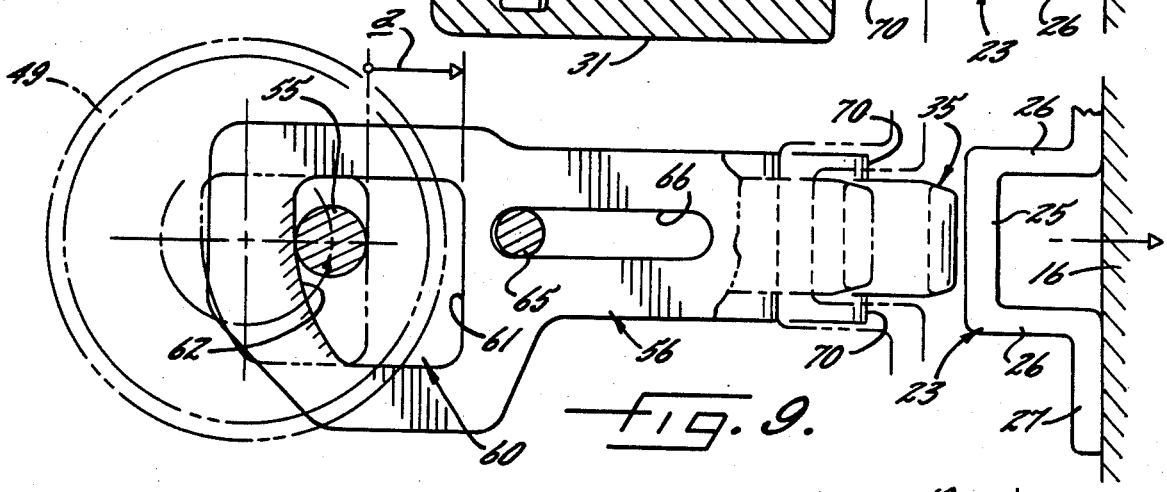

Positive outward displacement of the slide 56 stops when the crank pin 55 and the slide reach the position shown in phantom lines in FIGS. 8 and 9. In that position, the crank pin 55 is spaced 180 degrees from its initial position and engages a stop surface (not visible) in the housing 32. As a result of such engagement, the motor 39 stalls, stalling of the motor being effective to send a signal to a control (not shown) to effect deenergization of the motor. That same signal acts to activate the power operator 21 in a direction to open the sash 16.

As the sash 16 opens, the bail 25 of the strike 23 engages the outer leg 36 of the bolt 35 and pulls the bolt and the slide outwardly; outward movement of the slide independent of and relative to the crank pin 55 being possible by virtue of the substantial clearance between the pin and the inner edge 62 of the opening 60. As the bolt is pulled outwardly, it clears the rounded nose 76 of the cam plate 75 so as to permit the spring 72 to pivot the bolt counterclockwise to its fully unlocked position (FIG. 8) and to cause the leg 36 of the bolt to completely release the bail 25 of the strike 23. As the spring force pivots the bolt, the rounded surface 77 of the bolt reacts against the rounded nose 76 of the cam plate 75 and shifts the slide 56 outwardly even further to the position shown in solid lines in FIGS. 8 and 9. Movement of the slide to its second or outermost position is permitted by the lost-motion connection or clearance between the crank pin 55 and the opening 60 and is stopped when the inner edge 62 of the opening engages the crank pin. The distance through which the slide is pulled outwardly by the strike is indicated at a in FIG. 9.

Figure 10:
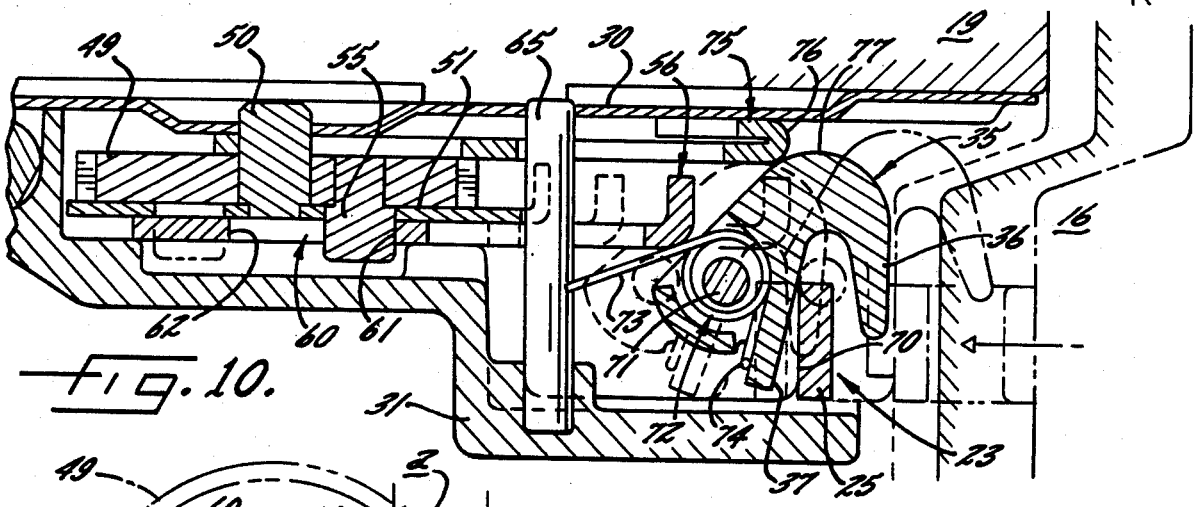
FIGS. 10 and 11 also are views similar to FIGS. 6 and 7, respectively, but show the latching bolt in an intermediate position.

The latch bolt 35 and the slide 56 remain in the position shown in solid lines in FIGS. 8 and 9 as long as the sash 16 is open. As the sash is closed by the power operator 21, the bail 25 of the strike 23 first engages the inner leg 37 of the bolt 35 and then pivots the bolt clockwise to the position shown in phantom lines in FIG. 10. With further closing of the sash, engagement of the bail with the inner leg 37 of the bolt 35 pushes the bolt and the slide 56 inwardly toward the position shown in solid lines in FIGS. 10 and 11. As the bolt approaches that position, the rounded nose 76 of the cam plate 75 acts against the rounded surface 77 of the bolt and cams the bolt clockwise to cause the outer leg 36 of the bolt to duck into the strike 23 in outwardly spaced relation with the bail 25. During inward movement of the bolt and the slide by the strike, some or all of the previously created clearance a between the crank pin 55 and the outer edge 61 of the opening 60 is taken up so that the outer edge of the opening either engages or is spaced outwardly just slightly from the pin when the power operator 21 stops closing the sash.

Figure 11:
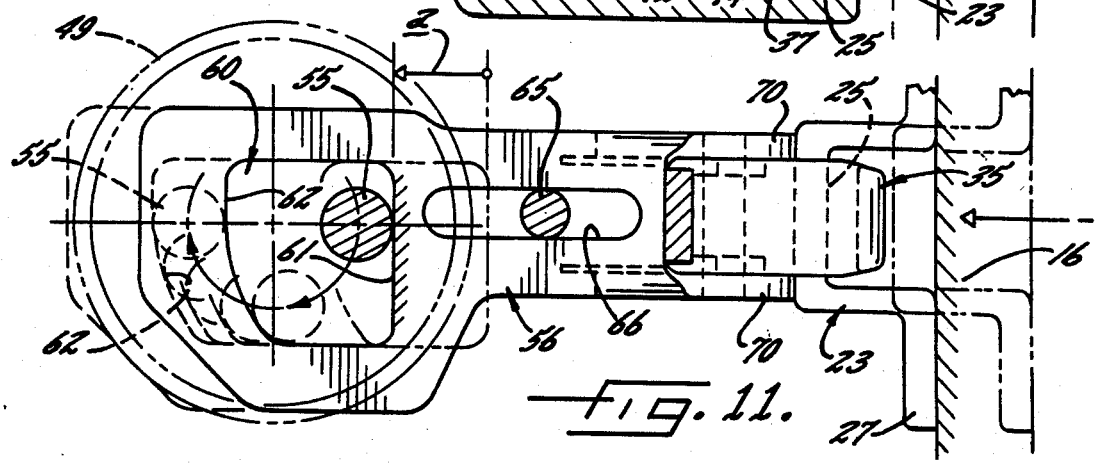

When the power operator 21 stops closing the sash 16 and stalls, a signal is relayed to the motor 39 to cause the motor to rotate the crank pin 55 in a clockwise direction. During initial clockwise rotation, the crank pin takes up the lost motion in the opening 60 and then engages the inner edge 62 of the opening to start positively displacing the bolt 35 and the slide 36 inwardly. As shown in FIG. 11, that portion of the inner edge 62 which is initially engaged by the pin is concavely curved rather than being straight. Such curvature provides a mechanical advantage to multiply the torque of the crank pin and enable the crank pin to exert more pull-in force per unit torque. Thus, the slide 56 is pulled inwardly with significant force and, during such movement, the cam plate 75 forces the bolt downwardly toward its fully locked position. As the crank pin 55 approaches the nine o'clock position, the latched bolt pulls the strike 23 inwardly and draws the sash 16 tightly against the seals on the jamb 19. Upon reaching the nine o'clock position, the crank pin stalls against a stop surface (not visible) in the housing 31 to stall the motor and create a signal for deenergizing the motor.

It will be apparent from the foregoing that final outward movement of the bolt 35 to its unlocked position is produced by opening of the sash 16 rather than by positively driving the bolt to its final position with the crank pin 55. By the same token, initial inward movement of the bolt toward its locked position is effected by closing of the sash and not by the power-driven crank pin. This freedom of movement is made possible by the lost-motion connection or clearance between the crank pin 55 and the opening 60 and enables the bolt to float to a position determined by the strike. In this way, the bolts of the lower and upper locking devices 15 and **15*a* may accommodate the positions of their respective strikes 23 and 23*a*** and properly engage such strikes even though the sash might be vertically warped.

The present invention also makes provision for unlocking the bolt 35 manually in the event power to the motor 39 is lost or in the event the lock 15 in some fashion malfunctions. For this purpose, means are provided for manually shifting the cam plate 75 inwardly to retract the plate from the bolt and permit the spring 72 to swing the bolt to its unlocked position. Herein, these means comprise a finger-operated lever 80 (FIGS. 2 and 4 and 12 to 14) located adjacent the inner end of the housing 31.

Figure 3:
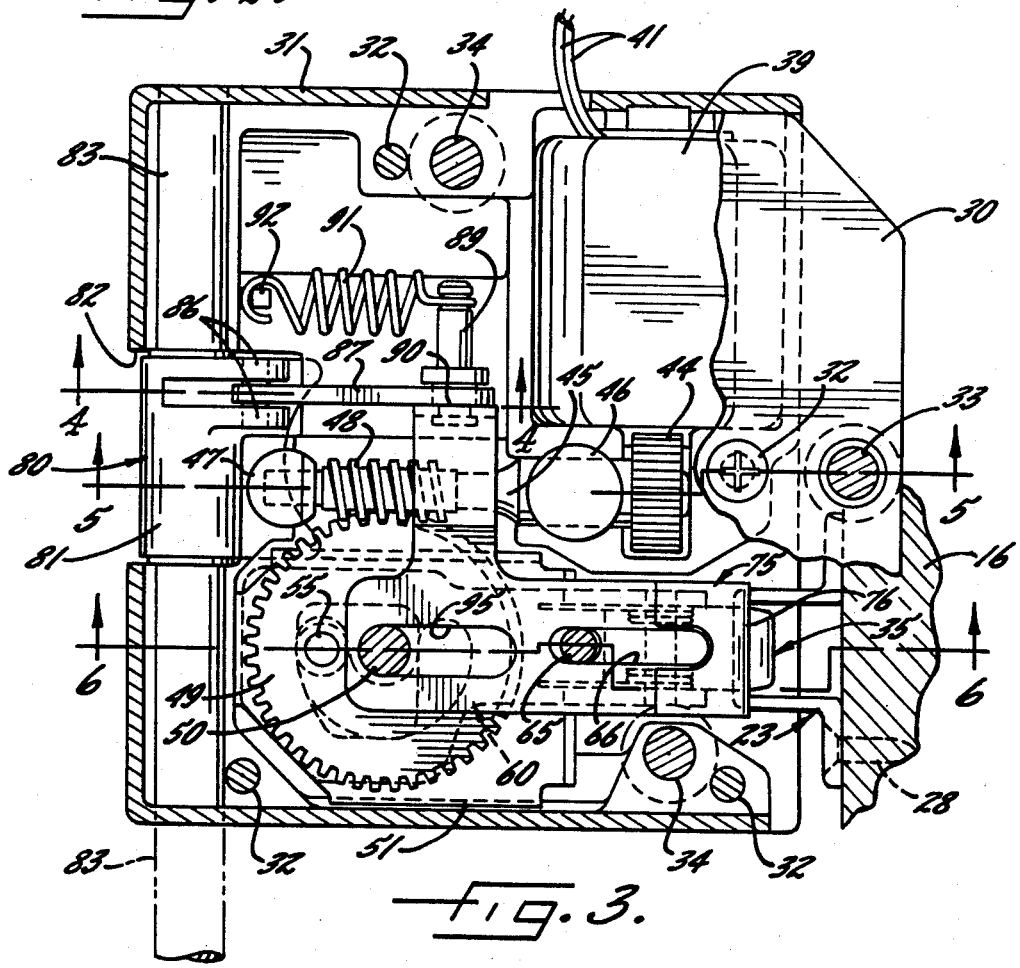
FIG. 3. is an enlarged fragmentary cross-section taken substantially along the line 3—3 of FIG. 2.

As shown in FIG. 3, the lever 80 includes a hub 81 which is located in a notch 82 in the housing 31. A rod 83 (FIGS. 12 and 13) extends rotatably through bosses 84 at the inner end of the housing and is secured rigidly to the hub by a set screw 85.

The hub 81 of the lever 80 is formed with a pair of vertically spaced ears 86 (FIG. 12) which are pivotally connected to one end portion of a link 87 by a pin 88. The other end portion of the link is pivotally connected by a pin 89 to a generally L-shaped bracket 90 on the cam plate 75. As shown in FIG. 13, the pin 89 extends through the bracket and is connected to one end of a tension spring 91. The other end of the spring is anchored to a tab 92 in the housing 31.

Figure 4:
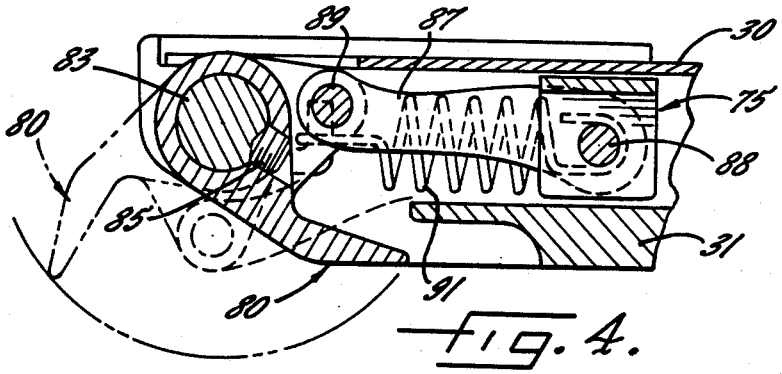
FIGS. 4 and 5 are enlarged fragmentary cross-sections taken substantially along the lines 413 4 and 5—5, respectively, of FIG. 3.
Figure 12:
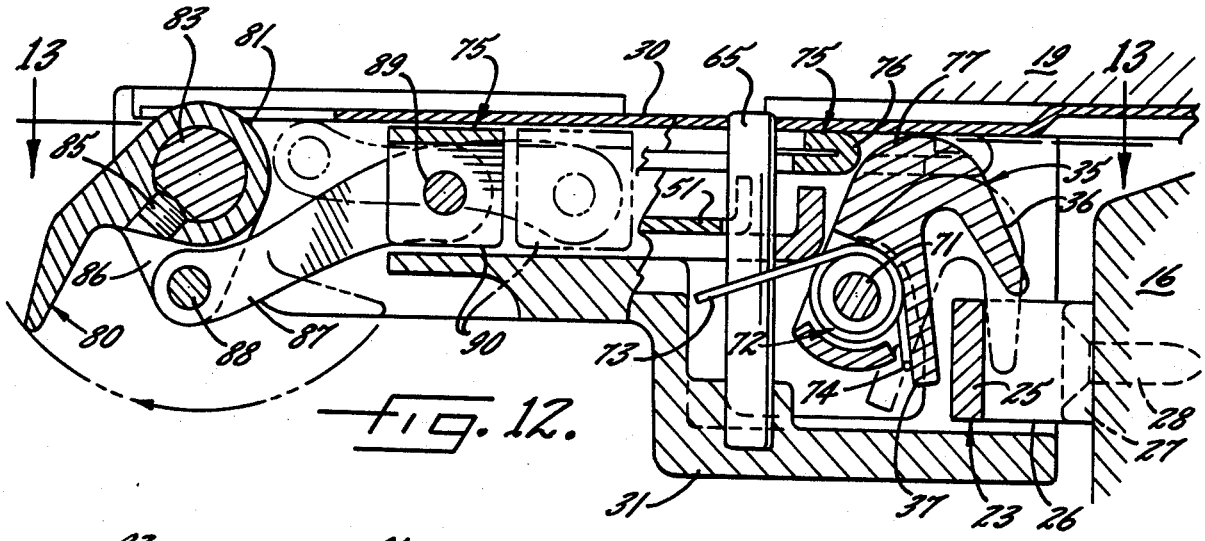
FIG. 12 is a fragmentary cross-sectional view showing the latching bolt being unlocked by a manual operation.

Normally, the lever 80 is disposed in a locked position as shown in solid lines in FIG. 4 and in phantom lines in FIG. 12. When the lever is in its locked position, the cam plate 75 is held outwardly in its normal position and prevents the bolt 35 from pivoting to its unlocked position. When the lever is in its locked position, the spring 91 is located to one side of the centerline between the pins 88 and 89 and thus urges the lever counterclockwise toward its locked position. Accordingly, the spring 91 acts through the lever 80 and the link 87 to hold the cam plate 75 outwardly in its normal position.

To manually release the bolt 35, the lever 80 is pivoted clockwise to an unlocked position as shown in solid lines in FIG. 12. As an incident to such pivoting, the lever acts through the link 87 to pull the cam plate 75 inwardly to a released position shown in solid lines in FIGS. 12 and 13. Thus, the cam plate is manually retracted away from the bolt 35 to enable the torsion spring 72 to pivot the bolt to its unlatched position. As the lever moves to its unlocked position, the centerline between the pins 88 and 89 swings to the other side of the tension spring 91 and thus the spring exerts a force tending to hold the lever in its unlocked position. Elongated slots 95 and 96 (FIG. 13) in the cam plate 75 receive the stud 50 and the guide pin 65, respectively, and permit the cam plate to shift relative to the stud and the guide pin when the cam plate is moved by the lever 80.

The rod 83 preferably is elongated and extends between the lower and upper locks 15 and 15*a* as shown in FIG. 1. Accordingly, both locks are manually released when the lever 80, 80*a* of either lock is manually pivoted to its unlocked position.

I claim:

1. A power-operated locking mechanism for locking a swingable window sash in a tightly closed position against a jamb of a window frame and selectively operable to release the sash for swinging to an open position, said locking mechanism comprising, in combination, a strike mountable on the sash, a lock unit mountable on the frame adjacent the jamb, said lock unit comprising a base, a carrier mounted on said base to move outwardly and inwardly toward and away from the sash, a latching bolt mounted on said carrier to move relative to the carrier between a latched position in which said bolt engages said strike and an unlatched position in which said bolt releases said strike, resiliently yieldable means for urging said bolt toward said unlatched position, an electrically energized power actuator, means connecting said actuator to said carrier and operable to move said carrier outwardly or inwardly in response to energization of said actuator, and means on said base for holding said bolt in said latched position during initial outward movement of said carrier and for releasing said bolt for movement toward said unlatched position when said carrier moves outwardly beyond a predetermined position, said holding means camming said bolt back toward said its latched position during inward movement of said carrier toward said predetermined position and maintaining said bolt in said latched position as said carrier moves inwardly beyond said predetermined position.

2. A power-operated locking mechanism for locking a swingable window sash in a tightly closed position against a jamb of a window frame and selectively operable to release the sash for swinging to an open position, said locking mechanism comprising, in combination, a strike mountable on the sash, a lock unit mountable on the frame adjacent the jamb, said lock unit comprising a base, a slide having inner and outer ends, said slide being mounted on said base to move linearly outwardly toward said sash from a first position to a second position and to move linearly inwardly away from said sash from said second position to said first position, a latching bolt mounted on said slide to pivot relative to the slide between a latched position in which said bolt engages said strike and an unlatched position in which said bolt releases said strike, resiliently yieldable means for urging said bolt to pivot toward said unlatched position, an electrically energized reversible actuator, means connecting said actuator to said slide and operable to move said slide outwardly from said first position toward said second position in response to operation of said actuator in one direction, said connecting means being operable to move said slide inwardly toward said first position in response to operation of said actuator in an opposite direction, and means on said base for holding said bolt in said latched position during initial outward movement of said slide from said first position and for releasing said bolt for pivoting toward said unlatched position as said slide approaches said second position, said holding means camming said bolt back toward said latched position during inward movement of said slide from said second position and maintaining said bolt in said latched position as said slide completes its inward movement to said first position.

3. A power-operated locking mechanism as defined in claim 2 in which said connecting means include a lost-motion connection between said actuator and said slide, said lost-motion connection permitting said slide to move inwardly and outwardly through a limited range independently of said actuator.

4. A power-operated locking mechanism as defined in claim 2 in which said connecting means comprise an opening formed in said slide and having inner and outer edges, said connecting means further comprising a rotatable eccentric disposed within said opening, said eccentric rotating one way and engaging the outer edge of said opening to shift said slide outwardly when said actuator is operated in said one direction, said eccentric rotating oppositely and engaging the inner edge of said opening to shift said slide inwardly when said actuator is operated in said opposite direction.

5. A power-operated locking mechanism as defined in claim 4 in which said eccentric comprises a crank pin adapted to be rotated back and forth along an arc by said actuator, the spacing between the inner and outer edges of said opening being substantially greater than the diameter of said crank pin so as to permit said slide to move inwardly and outwardly through a limited range relative to and independently of said crank pin.

6. A power-operated locking mechanism as defined in claim 5 in which the inner edge of said opening includes a concavely curved portion which is engaged by said crank pin when said crank pin moves said slide inwardly.

7. A power-operated locking mechanism as defined in claim 2 further including means on the outer end of said slide for engaging said strike and pushing said strike outwardly before said slide reaches said second position and before said bolt pivots toward said unlatched position.

8. A power-operated locking mechanism as defined in claim 2 further including means connected to said holding means and manually operable to move said holding means inwardly and permit said bolt to pivot to said unlatched position when said slide is in said first position.

9. A power-operated locking mechanism as defined in claim 8 in which said manually operable means comprise a lever pivotally mounted on said base to move between locked and unlocked positions, a link having a first end pivotally connected to said lever and having a second end pivotally connected to said holding means, and a spring acting on holding means and urging said holding means outwardly when said lever is in locked position and inwardly when said lever is in said unlocked position.

10. A power-operated locking mechanism as defined in claim 2 in which said strike comprises a generally U-shaped member having legs extending inwardly from said sash and having a cross piece, said legs having inner ends which are spanned by said cross piece, said bolt also comprising a generaly U-shaped member having inner and outer legs, the outer leg of said bolt being adapted to hook around the cross piece of said strike when said bolt is in said latched position, the cross piece of said strike pulling on the outer leg of said bolt and pivoting said bolt toward its unlatched position when said strke is moved outwardly during opening of said sash, and the cross piece of said strike engaging the inner leg of said bolt and pivoting said bolt toward its latched position when said strike is moved inwardly during closing of said sash.

11. A power-operated locking mechanism for locking a swingable window sash in a tightly closed position against a jamb of a window frame and selectively operable to release the sash for swinging to open position, said locking mechanism comprising a strike mountable on said sash, a lock unit mountable on said frame adjacent the jamb, said lock unit comprising a base, a slide having inner and outer ends, said slide being mounted on said base to move linearly outwardly toward said sash from a first position to a second position and to move linearly away from said sash from said second position to said first position, a generally U-shaped latching bolt having inner and outer legs, means mounting said bolt on said slide to pivot relative to the slide between a latched position in which the outer leg of said bolt hooks within said strike and an unlatched position in which the bolt releases the strike, resiliently yieldable means for urging said bolt to pivot toward said unlatched position, a reversible electric motor having rotary output shaft, a crank pin, means connecting said output shaft to said crank pin and operable to cause said crank pin to oscillate back and forth in an arc when said shaft is rotated first in one direction and then in an opposite direction, an opening in said slide and recieving said crank pin, said opening having inner and outer edges, said crank pin engaging the outer edge of said opening and moving said slide outwardly toward said second position when said output shaft is rotated in one direction, said crank pin engaging the inner edge of said opening and moving said slide inwardly toward said first position when said output shaft is rotated in the opposite direction, means on the outer end of said slide for engaging said strike and pushing said strike outwardly during outward movement of said slide, means on said base for holding said bolt in its latched position during initial outward movement of said slide from said first position and for releasing said bolt for pivoting to its unlatched position as said slide approaches said second position, the inner and outer edges of said opening being spaced from one another by a distance substantially greater than the diameter of said crank pin so as to permit said slide to move outwardly independently of said crank pin when said strike pulls on the outer leg of said bolt during opening of said sash, said strike engaging the inner leg of said bolt and pushing said slide inwardly during closing of said sash, and said holding means camming said bolt toward its latched position during initial inward movement of said slide and maintaining said bolt in its latched position as said slide completes its inward movement to said first position.

* * * * *